US006994040B2

(12) United States Patent
Rotter et al.

(10) Patent No.: US 6,994,040 B2
(45) Date of Patent: Feb. 7, 2006

(54) FLEXIBLE MULTI-HEAD, HEAVY DUTY STITCHER WITH AUTOMATIC BOBBIN LOADER

(75) Inventors: Martin J. Rotter, 115 Lismore Ave., Glenside, PA (US) 19038; Martin K. Wesstrom, Wilkes-Barre, PA (US)

(73) Assignee: Martin J. Rotter, Glenside, PA (US)

( * ) Notice: Subject to any disclaimer, the term of this patent is extended or adjusted under 35 U.S.C. 154(b) by 0 days.

(21) Appl. No.: 10/849,762

(22) Filed: May 20, 2004

(65) Prior Publication Data

US 2004/0261677 A1 Dec. 30, 2004

Related U.S. Application Data

(60) Provisional application No. 60/471,820, filed on May 20, 2003.

(51) Int. Cl.
*D05B 59/04* (2006.01)
*D05B 69/00* (2006.01)

(52) U.S. Cl. ..... 112/186; 112/221

(58) Field of Classification Search ..... 112/186, 112/154, 220, 157, 443, 258, 259, 284, 117, 112/118, 119, 98, 102, 221
See application file for complete search history.

(56) References Cited

U.S. PATENT DOCUMENTS

| | | | | | |
|---|---|---|---|---|---|
| 862,033 | A | * | 7/1907 | Toof | 112/168 |
| 2,561,643 | A | * | 7/1951 | Adler | 112/259 |
| 5,103,747 | A | * | 4/1992 | Resta et al. | 112/117 |
| 5,287,820 | A | * | 2/1994 | Stutznacker | 112/117 |
| 5,775,243 | A | * | 7/1998 | Kinoshita et al. | 112/186 |
| 6,041,725 | A | * | 3/2000 | Resta | 112/470.05 |
| 6,079,341 | A | * | 6/2000 | Resta | 112/117 |

* cited by examiner

*Primary Examiner*—Ismael Izaguirre
(74) *Attorney, Agent, or Firm*—Volpe and Koenig, P.C.

(57) ABSTRACT

A sewing machine is provided having an automatic bobbin loader. The automatic bobbin loader includes a hook assembly mounted beneath the sewing plane having a bobbin receiver. The hook assembly is driven by a drive shaft, and is moveable from a first, operating position, to a second, loading position. A bobbin loader is mounted adjacent to the hook assembly in the second position. The bobbin loader includes a suction tube that removes any remaining bobbin core. The bobbin loader then loads a replacement bobbin from the bobbin loading assembly into the bobbin receiver, prior to the hook assembly being returned to the operating position. Additionally, in order to sew through thick material, the needle is carried by a needle carriage which moves in time with the material being sewn to maintain the needle generally vertical throughout the time it is in the material being sewn.

31 Claims, 18 Drawing Sheets

10
218
220
222
228
66
224
242
230
131
210
201
204
202
212
206
135
133
22
208
240

FLEXIBLE MULTI-HEAD, HEAVY DUTY STITCHER WITH AUTOMATIC BOBBIN LOADER

CROSS-REFERENCE TO RELATED APPLICATIONS

This application claims the benefit of U.S. Provisional Application No. 60/471,820, filed May 20, 2003, which is incorporated by reference herein as if fully set forth.

BACKGROUND

The present invention relates to sewing or stitching machines, and more particularly to sewing or stitching machines that make a lock stitch using an upper thread carried by a needle and a lower bobbin thread, or any other industrial stitch.

Sewing machines have long been known which utilize an upper thread carried by a needle which is inserted through layers of material to be sewn together. A hook shuttle mechanism engages a loop in the thread at the needle end and loops the thread around the bobbin in order to form a lock stitch prior to the needle being withdrawn back through the material as the material is advanced to form the next stitch. Such sewing machines have been dramatically improved over the years with electronic controls which enable various types of automated stitching to be carried out. However, a drawback to these known types of sewing machines is that they are only capable of penetrating fabrics or materials of a limited thickness due to several factors, including the fact that the needle is tilted as it moves in and out of the material in order allow it to travel with the material being sewn during the insertion period. Additionally, since the bobbin must be looped by the upper thread in order to form a locked stitch, the capacity of such machines for automated work is limited by the need to replace the bobbin on a regular basis as the bobbin thread is exhausted.

There are several inventions which relate to monitoring the amount of bobbin thread left so that an operator knows when to change the bobbin prior to running out of thread. However, this does not address the down time required to change the bobbin and restart stitching, especially in the middle of long seams. Additionally, the process of trimming upper and lower threads and the requirement to remove the material being sewn, in many cases in order to access the bobbin, has proven to be an additional limiting factor on productivity losses due to required bobbin changes.

In applications such as stitching strapping material together, for example, such as straps used for dropping 20,000 pound payloads with supplies and equipment into remote areas and/or for military use, the need to be able to stitch through multiple layers of high strength strapping material cannot be met with known equipment, and work arounds are required for sewing through less material in multiple areas.

In other applications where it is desired to sew a non-permeable layer of material on top of a strip of coarse matting, the known sewing machines cannot achieve this objective due in part to the limited height capacity and the inability to address the thickness of material that the needle can penetrate and still sew a uniform lock stitch. Additionally, in some applications, such as sewing tarps or large covers, parallel seams are required that may be spaced apart from one to several inches and/or multiple rows of stitching may be required for strength. Currently, this must be done with multiple passes through a sewing machine which is both time consuming and difficult, depending upon the length of the material being sewn and the amount of bobbin thread which can be wound on a bobbin.

It would be desirable to produce a sewing machine having the flexibility to address many of these problems and to provide the ability to sew multiple layers of material together with one or several rows of stitching. It would also be extremely beneficial to solve the long known problem of having to replace bobbins in the middle of a seam.

SUMMARY

Briefly stated, present invention provides a heavy duty sewing machine that addresses the above-noted concerns with the known sewing machines and which allows for sewing multiple layers of material together up to approximately four inches in thickness or more.

In accordance with one aspect of the invention, a sewing machine is provided having an automatic bobbin loader. The automatic bobbin loader comprises a hook assembly mounted beneath the sewing plane having a bobbin holder. The hook assembly is driven by a drive shaft, and is moveable, preferably by pivoting, from a first, operating position, to a second, loading position. A bobbin loader is mounted adjacent to the hook assembly in the second position. The bobbin loader includes a suction tube that removes any remaining bobbin core and loose threads. Suction is applied to withdraw any remaining bobbin core which is nearly spent. The bobbin loader then loads a replacement bobbin from the bobbin loading assembly into the bobbin receiver in the hook assembly. The bobbin loader preferably moves away from the hook assembly and the hook assembly is returned to the first, operating position.

In a preferred embodiment, the hook assembly is rotatable about the hook drive shaft so that it is not necessary to disengage and re-engage the drive system, which could potentially result in a loss of timing.

Preferably, the bobbin loader is also moveable toward and away from the hook assembly for loading the bobbin and to provide clearance while the hook assembly is moved.

In a preferred embodiment, the hook assembly includes a sensor to detect when the bobbin is nearly spent. Additionally, preferably the dogs for driving the material through the sewing machine are provided as a plurality of toothed rollers which are engagable and disengagable from a drive wheel when the hook assembly is moved from the first, operating position to the second, bobbin loading position.

In a preferred embodiment, the bobbin loader includes a supply of bobbins loaded on a feed rod. In order to load a single bobbin into the bobbin receiver of the hook assembly, the bobbins on the feed rod are pushed forward such that the last bobbin slides off the end of the feed rod and into the bobbin receiver. Preferably a control arm allows only one bobbin to be released from the feed rod into the bobbin receiver.

In the preferred embodiment, the bobbin loader is preferably mounted for movement in at least two axes to allow for movement toward and away from the hook assembly when it is in the second, loading position. In a preferred embodiment, the suction tube is formed with a venturi and is mounted for pivoting movement on the bobbin loading assembly.

Preferably, a bobbin hold-down arm is mounted separately from the hook assembly and is driven up and down in time with the sewing machine drive such that it is lifted upwardly from the bobbin to allow the loop of upper thread to pass under the arm. Additionally, sensors are attached to the arm so that it senses when the bobbin is nearly spent and signals a controller, triggering the reloading operation to automatically occur.

In the preferred embodiment, upon the hold down arm sensing the bobbin is nearly spent, a bobbin thread cutter engages the bobbin thread and cuts it. Additionally, preferably an upper thread cutter engages the upper thread and cuts it to prevent additional thread pulling during the bobbin changing operation. The hook assembly then rotates from the first, operating position to the second, loading position where any remaining portion of the original bobbin is removed via the suction tube and a new bobbin is loaded.

In one preferred embodiment, the hook assembly is also slidable along the drive shaft so that it can be positioned in any one of a number of positions in order to allow the throat width of the sewing machine to be adjusted and/or to allow multiple sewing heads to be placed adjacent to each other, as described in more detail below.

In another aspect of the invention, one or more sewing heads can be mounted on the sewing machine and adjusted to a desired spacing to allow for multiple stitching to occur at the same time.

In one preferred embodiment, the hook assembly is rotated from the first position to the second position via a rotary drive.

In another aspect of the invention, the additional bobbins located on the bobbin holding rod are inserted into the bobbin receiver of the hook assembly using a blast of air pressure.

In another aspect of the invention, the bobbin loader can be moved to a restocking position where one or more new bobbins can be loaded while the sewing machine continues to operate. Preferably, the feed rod is pivoted toward an operator or an automated restocking device in the restocking position so that a plurality of new bobbins can be loaded at the same time.

In another aspect of the invention, in order to allow the sewing machine to sew through multiple layers of thick material, which can have thicknesses of 2 inches, 3 inches and even 4 inches or greater, that are to be sewn together using a uniform lock stitch, the upper thread carrying needle is mounted on a needle carriage. The needle carriage is mounted for sliding horizontal movement in time with the movement of the material being sewn by the sewing machine. The needle is mounted for transverse movement (up and down) in the needle carriage. This allows the needle to be moved upwardly and downwardly in order to sew while the entire needle carriage moves horizontally back and forth in time with the material being sewn during the period that the needle is inserted such that the needle is maintained in a generally parallel, vertical alignment during a sewing operation. This eliminates tilting of the needle, which can cause the needle to break in thick and/or stiff materials which are to be sewn together. This also allows for high speed sewing through multiple thicknesses of material since there is no binding tilting movement of the needle.

Preferably, the needle carriage is mounted for sliding movement on at least two horizontal guide rods and is driven in time with the movement of the needle into the material to be sewn, and moved horizontally in time with the rollers which draw the material to be sewn through the sewing machine.

In a preferred embodiment, the multiple upper heads of the sewing machine are mounted for sliding movement on the sewing machine upper frame and drive shafts so that the distances between multiple needles for parallel sewing can be adjusted to any desired spacing.

Preferably, a thread pull and thread cutoff devices are provided for the upper thread and include a first hook driven by an actuator which creates extra slack in the upper thread and a second actuator which draws the thread from the needle to an actuator driven cutting device which cuts the thread while still leaving a sufficient tail through the needle to restart the sewing operation without having to rethread the needle.

Although the features and elements of the present invention are described in the preferred embodiments in particular combinations, each feature or element can be used alone (without the other features and elements of the preferred embodiments) or in various combinations with or without the other features and elements of the present invention.

BRIEF DESCRIPTION OF THE DRAWINGS

The foregoing summary, as well as the following detailed description of the preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements shown.

DETAILED DESCRIPTION OF THE PREFERRED EMBODIMENTS

Figure 1:
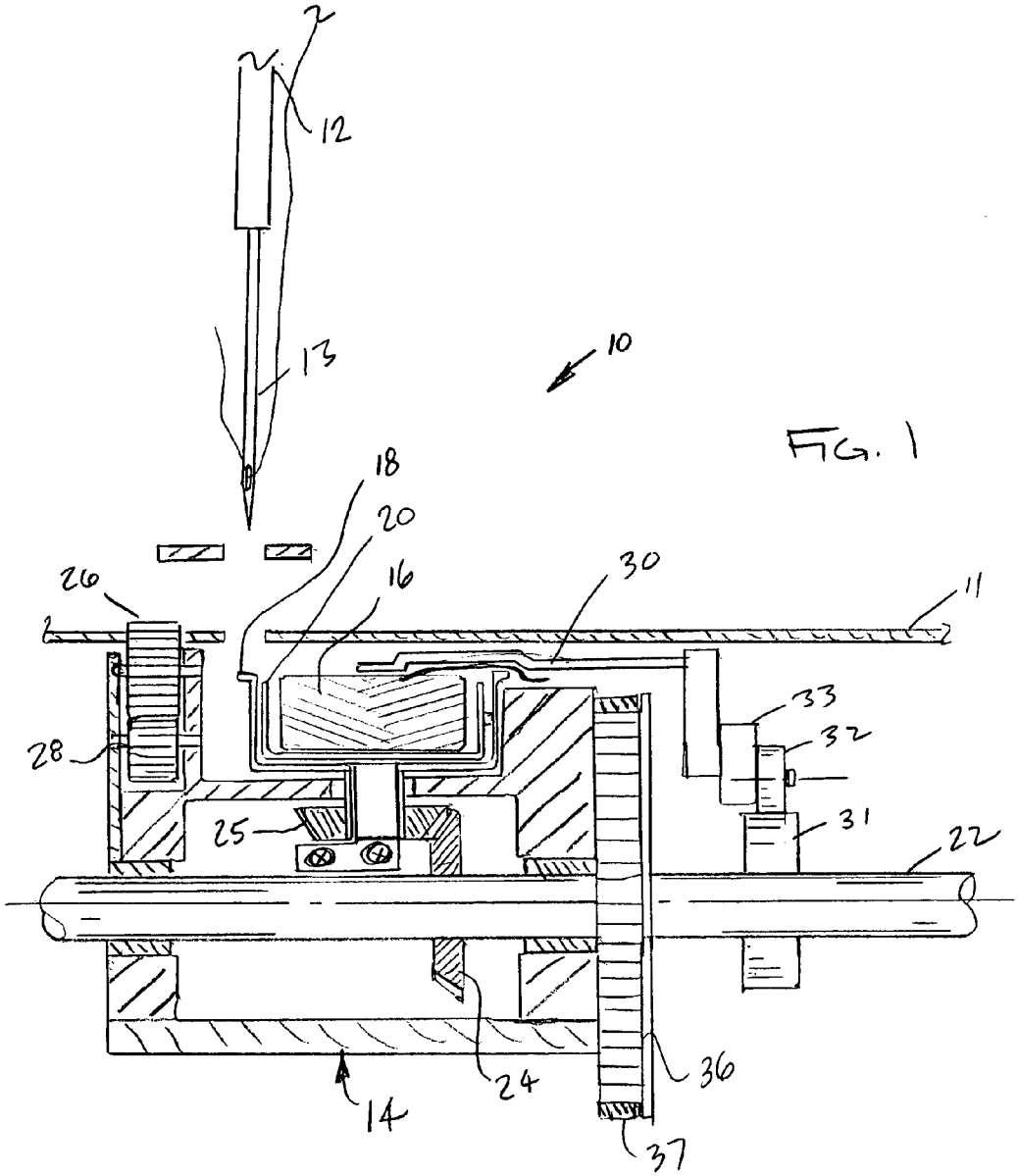
FIG. 1 is a front elevational view, partially in cross-section, showing the upper needle and lower hook assembly with a bobbin for a sewing machine in accordance with a preferred embodiment of the present invention.

Certain terminology is used in the following description for convenience only and is not considered limiting. The words "lower", "upper", "left" and "right" designate directions in the drawings to which reference is made. Additionally, the terms "a" and "one" are defined as including one or more of the referenced item unless specifically noted.

Figure 5:
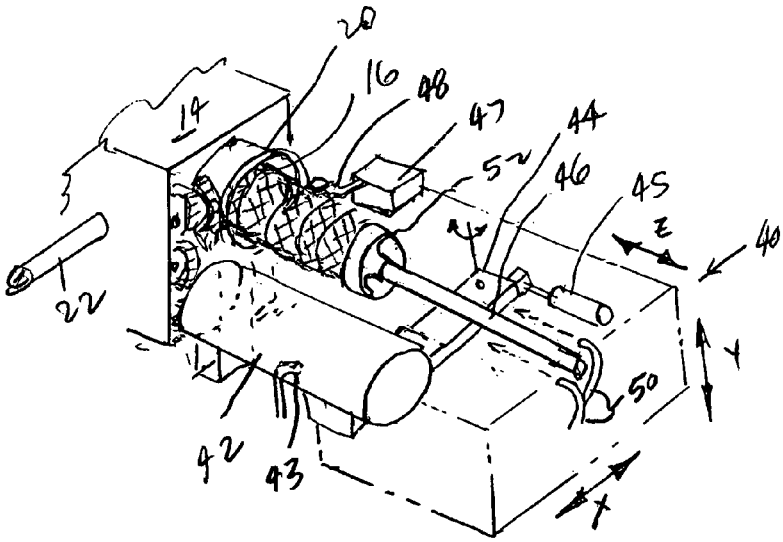
FIG. 5 is a perspective view similar to FIG. 4 showing an end-most bobbin on the bobbin holding rod of the bobbin loading assembly being loaded into the bobbin receiver of the hook assembly.
Figure 6:
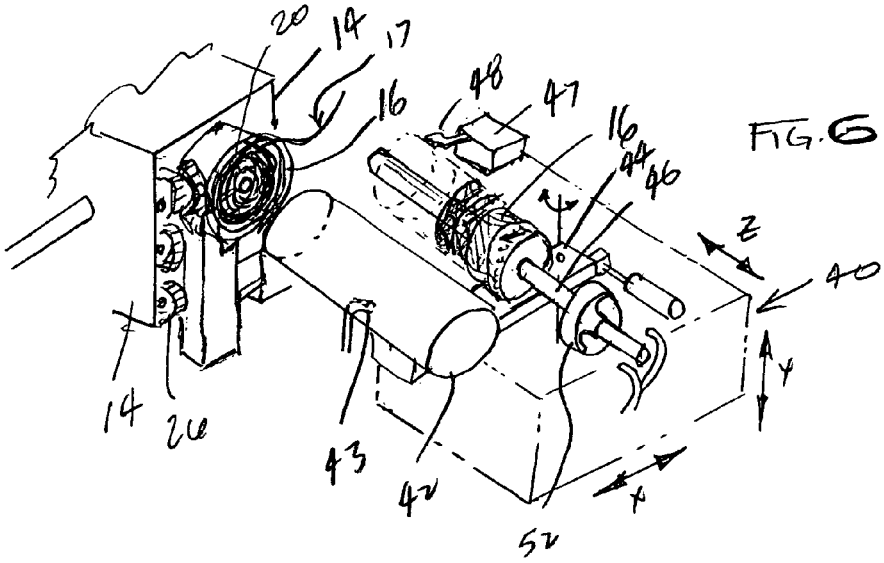
FIG. 6 is a perspective view similar to FIG. 3 showing the loaded bobbin in position as the bobbin loading assembly is pulled away.
Figure 7:
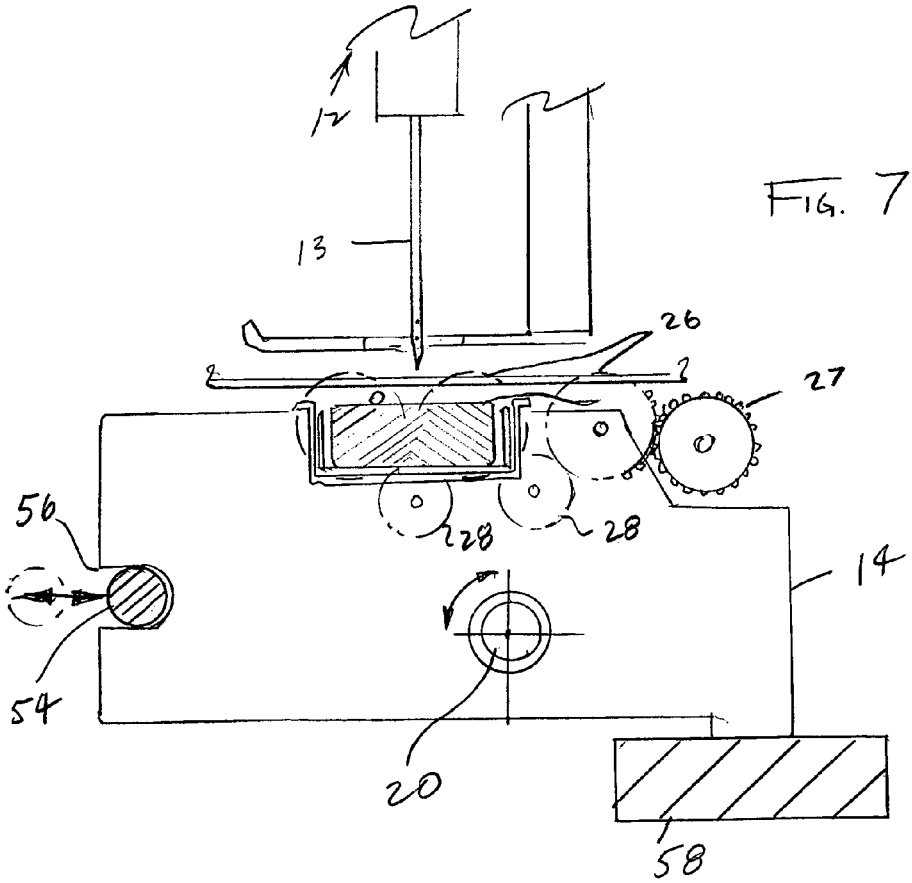
FIG. 7 is a side elevational view showing the hook assembly rotated back into the first, operating position.
Figure 8:
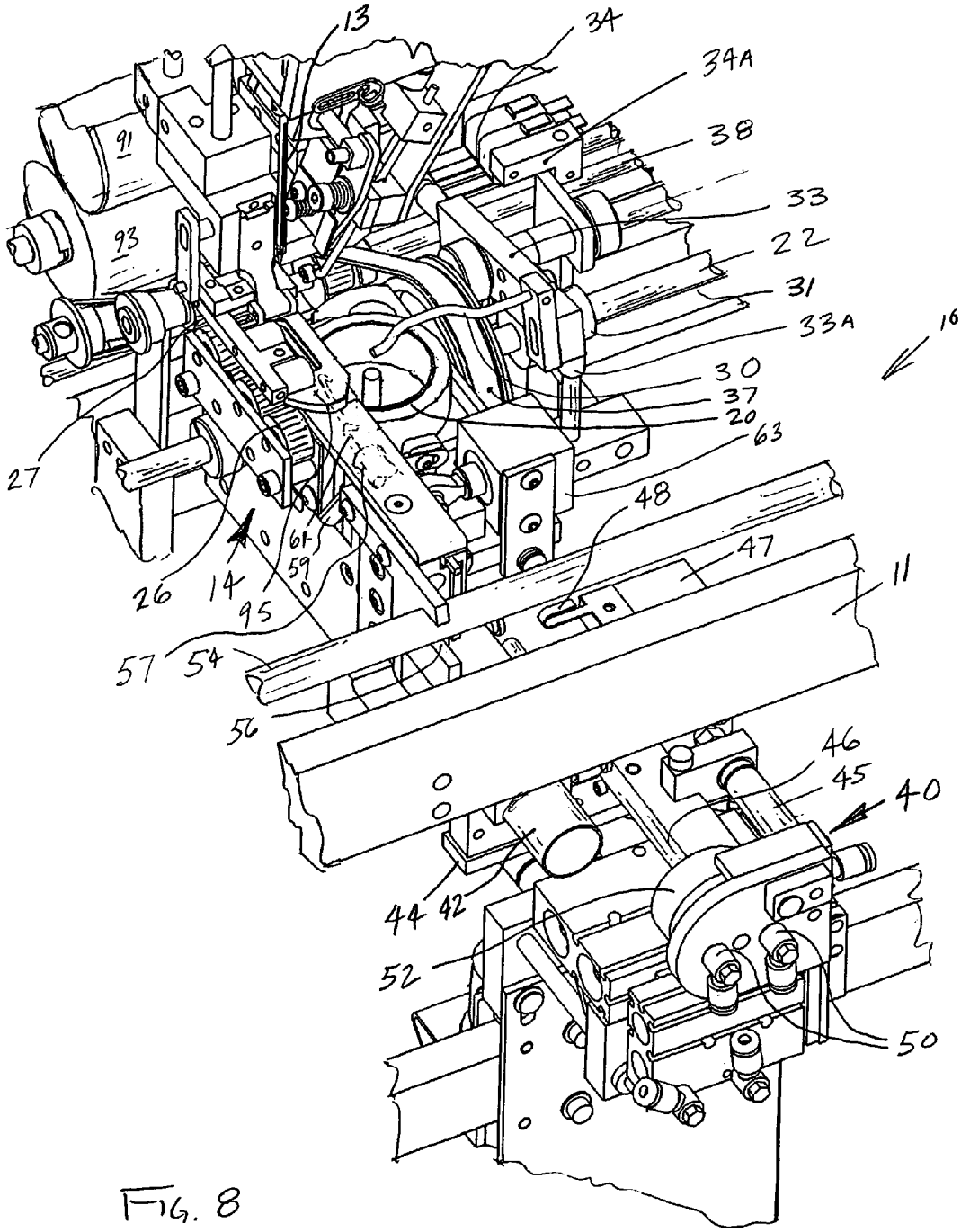
FIG. 8 is a detailed perspective view of a preferred embodiment of the invention showing the hook assembly and the bobbin loading assembly in a first position of the hook assembly.

Referring now to FIGS. 1–9, an automatic bobbin loading sewing machine 10 in accordance with present invention is shown. The sewing machine 10 preferably includes a frame 11 (shown in more detail in FIGS. 12 and 13) having upper needle carrying heads 12 and lower hook assemblies 14 which carry the bobbin 16 for each upper needle head 12/lower hook assembly 14 combination. As shown in FIG. 1, the hook assembly 14 preferably includes a rotating hook 18 which revolves around the bobbin receiver 20. The hook 18 is driven by a drive shaft 22 and a pair of bevel gears 24, 25. Drive dogs in the form of material feeding gears 26 are located adjacent to the needle opening and are driven by a separate drive gear 27, as shown in FIG. 7. Idler gears 28 are located between the gears 26 so that they all drive in the same direction. A bobbin holder/sensor arm 30 keeps the bobbin 16 in position and is driven via a cam 31 on the drive shaft 22 through a roller follower 32 that moves the arm support bar 33 up and down in time with the movement of the hook 18 so that the upper thread loop can be passed around the bobbin 16. Sensors 34 are attached to the end of the arm, as shown in FIG. 8, to sense when the arm 30 dips downwardly indicating that the bobbin thread on the bobbin 16 has been almost used up. An actuator gear 36 is connected to the hook assembly 14 and is preferably driven by a tooth belt 37 to move the hook assembly 14 to a bobbin loading position after the bobbin loader/sensor arm 30 indicates that the bobbin thread is almost spent.

While a 90° rotation is the preferred movement, other arrangements could be utilized to cause the hook assembly 14 to traverse vertically and/or horizontally to a bobbin reloading position.

Figure 2:
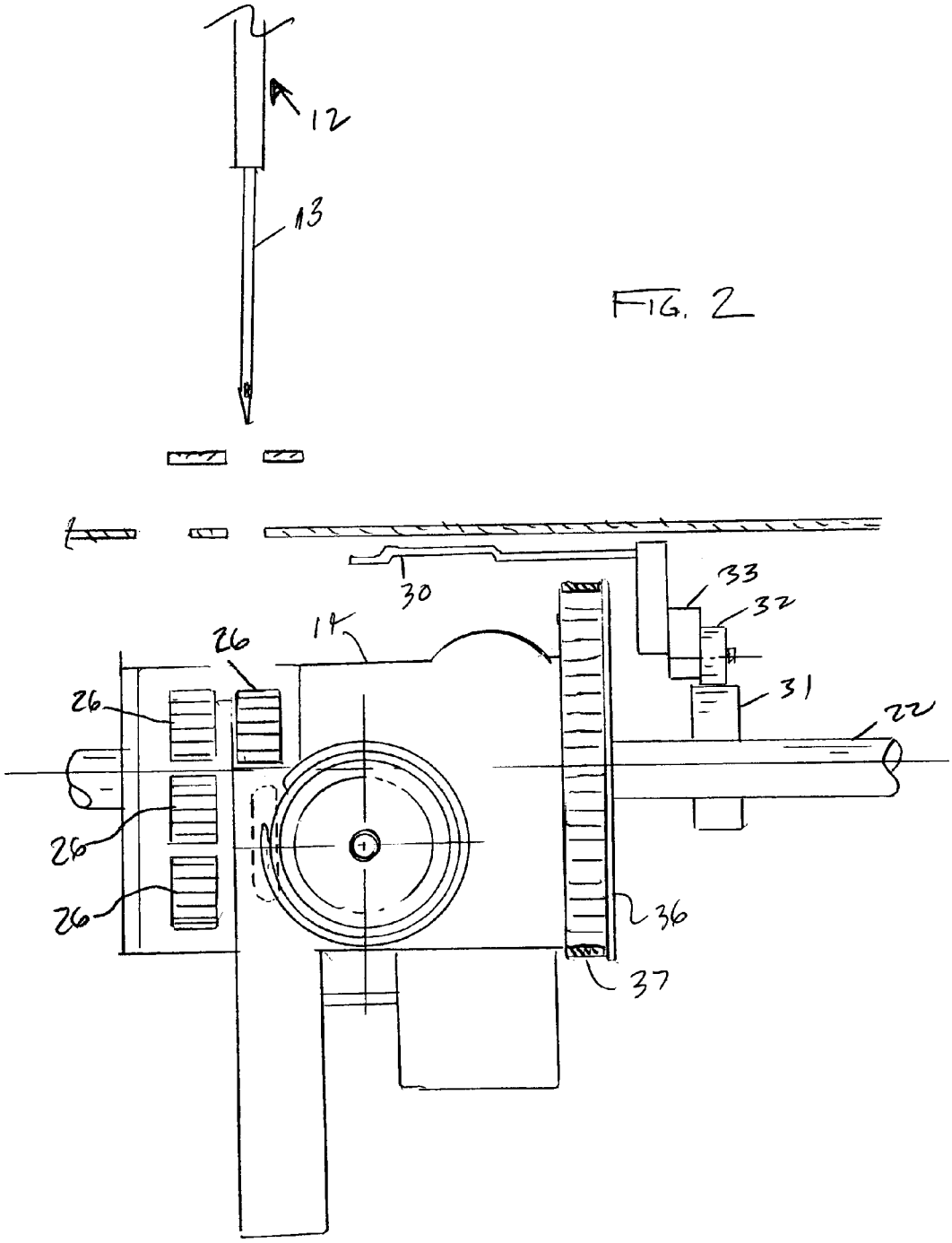
FIG. 2 is an elevational view, similar to FIG. 1, with the hook assembly rotated 90 degrees such that the bobbin receiver is moved from a generally vertical orientation to a generally horizontal orientation.
Figure 3:
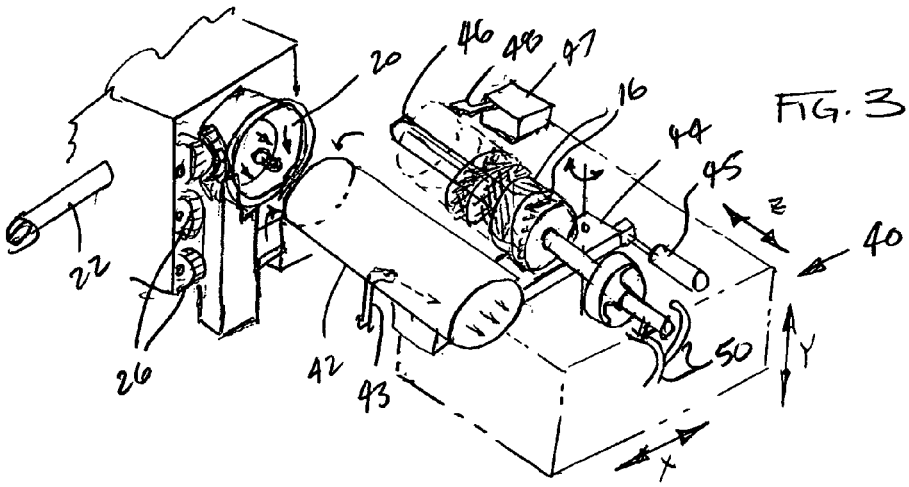
FIG. 3 is a perspective view, partially broken away, showing the hook assembly in the position shown in FIG. 2 with a bobbin loader assembly moving into position to suction the nearly spent bobbin from the bobbin receiver.
Figure 4:
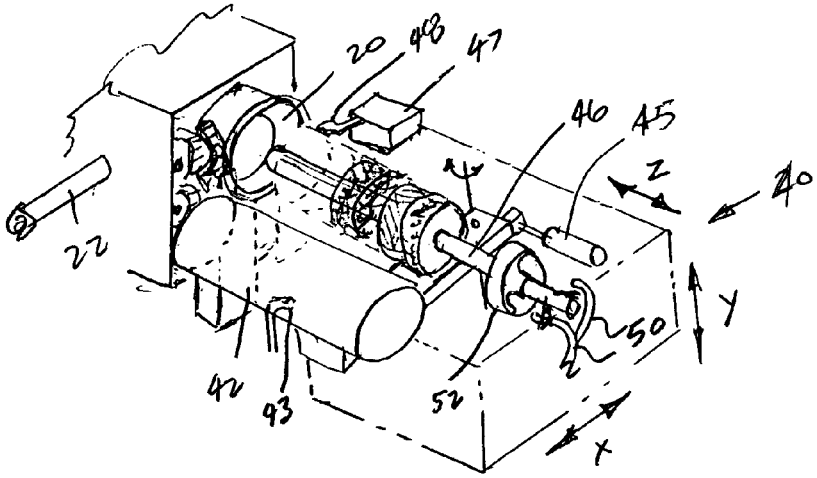
FIG. 4 is a perspective view similar FIG. 3 in which the bobbin loader has moved to a second position in which the bobbin loading mechanism is aligned with the bobbin receiver in the hook assembly.

As shown in FIG. 2, after the upper and lower bobbin threads are cut by automatic cutting mechanisms, described in detail below, the entire hook assembly 14 is preferably rotated down by the toothed belt 37 driving the actuator gear 36 attached to the hook assembly 14. This rotation preferably takes place about the drive shaft 22. The material feeding gears 26 become disconnected from the drive gear 27 (shown in FIG. 7). Once the hook assembly 14 has rotated to the position in FIG. 2, an automatic bobbin loader 40, which is shown in FIGS. 3–6, is utilized in order to insert a new bobbin 16 into the bobbin receiver 20. As shown in FIG. 3, the auto bobbin loader 40 includes a suction tube 42 having an air jet 43 which faces in a direction generally away from the bobbin receiver 20. The bobbin loader 40 is mounted for movement preferably in the X and Y directions. In a preferred embodiment, the bobbin loader 40 is also movable in a Z direction so that it can be moved out of the way of the hook assembly 14 to allow it to rotate into position prior to being moved into a first position generally shown in FIG. 3, where the suction tube 42 is adjacent to the bobbin receiver 20. Air is blown through the air jet 43 to create a venturi effect, suctioning any remaining bobbin thread or spool still in the bobbin receiver 20 out and away to be discarded. Preferably, the suction tube 42 is mounted on a swiveling arm 44 actuated by an actuator 45 so that it can be pivoted slightly away from the bobbin receiver 20 and allow the bobbin loader 40 to traverse only in the X direction for its next move such that the bobbin loading rod 46 is generally aligned with the bobbin receiver 20, as shown in FIG. 4.

The bobbin loading rod 46 preferably comprises a rod onto which a plurality of bobbins 16 can be easily slid, such as through providing bobbins 16 stacked in a tube which can then be easily slid out and onto the rod 46. In a preferred embodiment, the bobbins 16 can be placed on the loading rod 46, and are freely slidable thereon. To allow for easier loading, the bobbin loader itself can be moveable to a reloading position, as described in further detail below, or the rod 46 can be pivotably mounted so that it pivots to an easily accessible loading position.

An actuator 47 (shown in detail in FIG. 11) with an arm 48 is located adjacent to the end of the bobbin loader 46 to prevent the bobbins 16 from inadvertently coming off the end. Once the bobbin loader 46 is positioned adjacent to the bobbin receiver 20, air is applied via jets 50, as shown in FIG. 5, against a cup shaped driver 52 located on the loading rod 46, which presses the bobbins 46 forward. The actuator 47 moves the arm 48 such that one bobbin 16 is loaded into the bobbin receiver 20. The actuator 47 then reclamps the arm 48 into position to prevent any further bobbins 16 from coming off the loader 46. The automatic bobbin loader 40 is then moved away form the bobbin receiver 20, as shown in FIG. 6, such that the bobbin 16 remains in the bobbin receiver 20.

It is noted that in the preferred embodiment of the invention, the tail 17 of the bobbin thread 16 must be loose and it has been found in practice that the bobbin 16 can be loaded onto the bobbin loading rod 46 with the tails dangling several inches without any problems. While the mechanism for moving the bobbin loader 40 in the X, Y and Z directions is preferably air cylinder actuators and appropriate linear guides, any suitable mechanism could be utilized. Additionally, the pivoting arm could be omitted depending upon the specific path of travel programmed for the bobbin loader 40; however, it has been found to be particularly effective to have this tilt inwardly to place the suction tube 42 into close proximity to the bobbin receiver 20 in order to ensure that any remaining portion of the spent bobbin is completely sucked out.

Referring to FIG. 7, the front support bar 54 which holds the hook assembly 14 in the operating position is shown. The support bar 54 can be moved inwardly and outwardly, and preferably engages in a slot 56 of the hook assembly 14 to provide firm support to carry the load generated by the needle 13 as it drives through the material to be sewn. Preferably, the back end of the hook assembly 14 also contacts a fixed support member 58 of the frame 11 of the sewing machine 10 for additional support and load carrying capability.

FIG. 8 provides a detailed view of the hook assembly 14 in the first, operating position and the automatic bobbin loader 40 in a standby position. Feed rollers 91 and 93 are shown in position at the back of the hook 14 for pulling material through, in addition to the foot 95 that is moved down into place to press the material against the drive gears 26. Preferably, the foot 95 is raised and lowered pneumatically, and also preferably includes rollers. The pivot actuator shaft 38 used to drive the toothed belt 37 is also clearly shown. While this is a rotary means of actuation in the preferred embodiment, a straight linear actuator with pivot connections could be utilized if desired. The limit stop 33*a* for the arm 33 is also clearly shown. This stop 33*a* is preferably adjustable to prevent over-travel of the arm 33, especially when the hook assembly 14 is rotated downward to the bobbin loading position, shown in detail in FIG. 9. The mount 34*a* for the sensor 34 is also shown. The automatic bobbin loader 40 is also shown in further detail.

Figure 9:
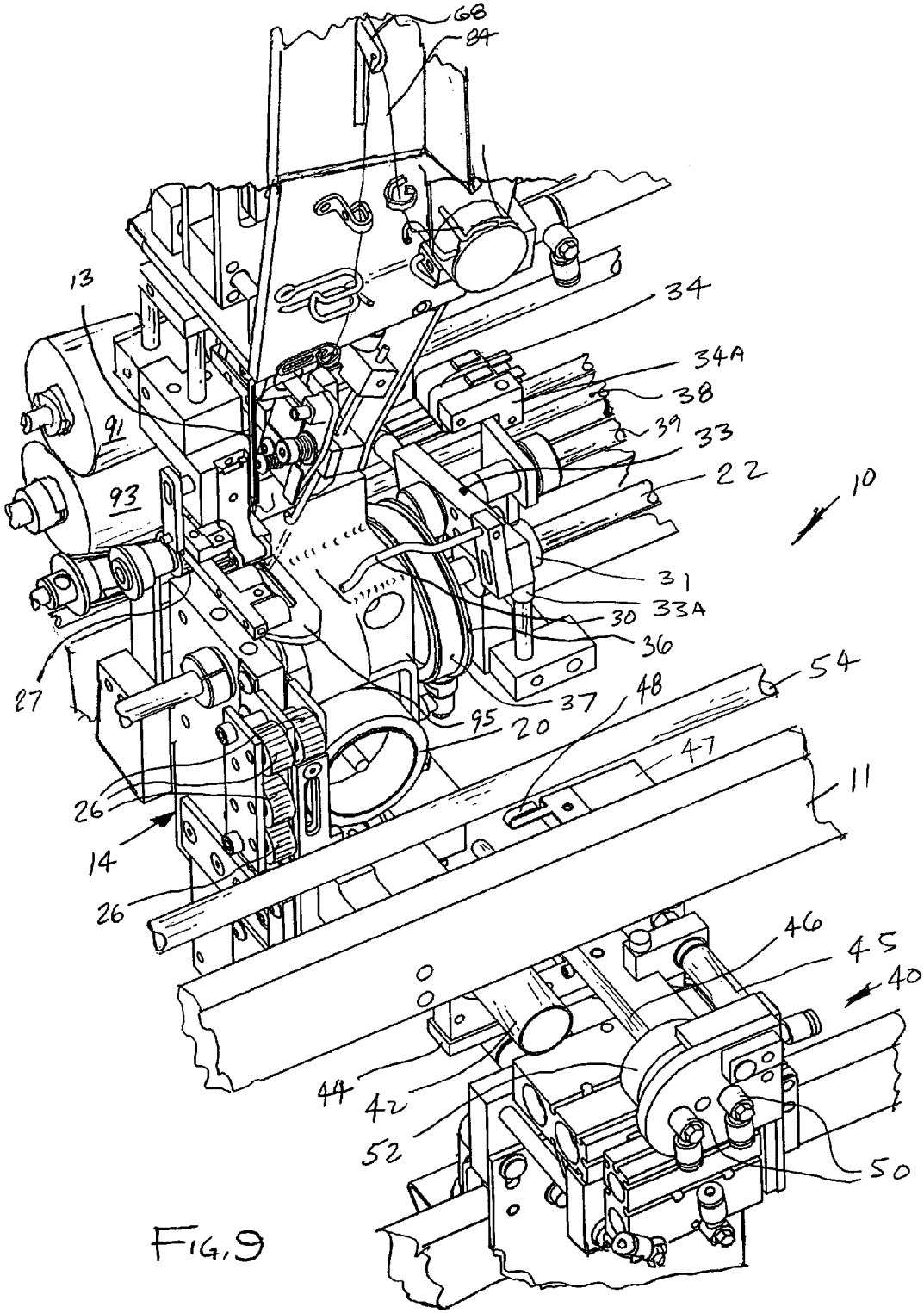
FIG. 9 is a detailed perspective view similar to FIG. 8 showing the hook assembly rotated to a position where the bobbin receiver can be loaded with a new bobbin.

Referring now to FIG. 9, a detailed view of the hook assembly 14 rotated to a position where the bobbin receiver 20 can be loaded with a new bobbin 16 by the automatic bobbin loader 40 is shown. The bobbin holder/sensor arm 30 which extends from the arm 33 is held in position by the stop 33*a* and does not rotate down with the hook assembly 14. The shaft 39 upon which the arm 33 pivots is also clearly shown. The drive gear 27 with its associated toothed drive belt and pulleys can also be seen disengaged from the feed gears 26.

While the preferred embodiment of the automatic bobbin loader 40 for the sewing machine 10 has been described in detail, a key feature of the preferred embodiment which allows the movement of the hook assembly 14 to be carried out is to make the hook assembly 14 pivotable about the drive shaft 22. This arrangement ensures that there are no timing issues created by disconnecting or reconnecting the hook drive. This also allows the bobbin receiver 20 on the hook assembly 14 to rotate downwardly to provide easier access for automatically changing the bobbin 16. The hook assembly 14 also does not include a latch on the center pin, which is common on most hook assemblies, and the center pin can also be omitted, if desired. In the present case, the hook assembly 14 was made by modifying a standard hook available from Seiko Company, Japan, by removing the center pin latch. The center pin can also be removed and replaced by a small centering ball at the base of the bobbin basket or receiver. No latch is needed since the bobbin is held in position by the arm 30 during normal sewing operations when the hook assembly 14 is in the first, operating position.

Referring again to FIG. 8, an actuator 57 which draws the bobbin thread 16 into a cutter 59, is shown. The hook end of the rod 61 having the end which hooks the bobbin thread and draws it into the cutter is shown in dashed lines. Cutter actuator 63 is then actuated in order to cut the bobbin thread. The cutter 59 and actuators 57 and 63 are preferably mounted on the rotatable hook assembly 14 in order to maintain both the proximity of the cut of the bobbin thread and the alignment of the rod 61 which catches the bobbin thread and draws it into the cutter 59.

Figure 10:
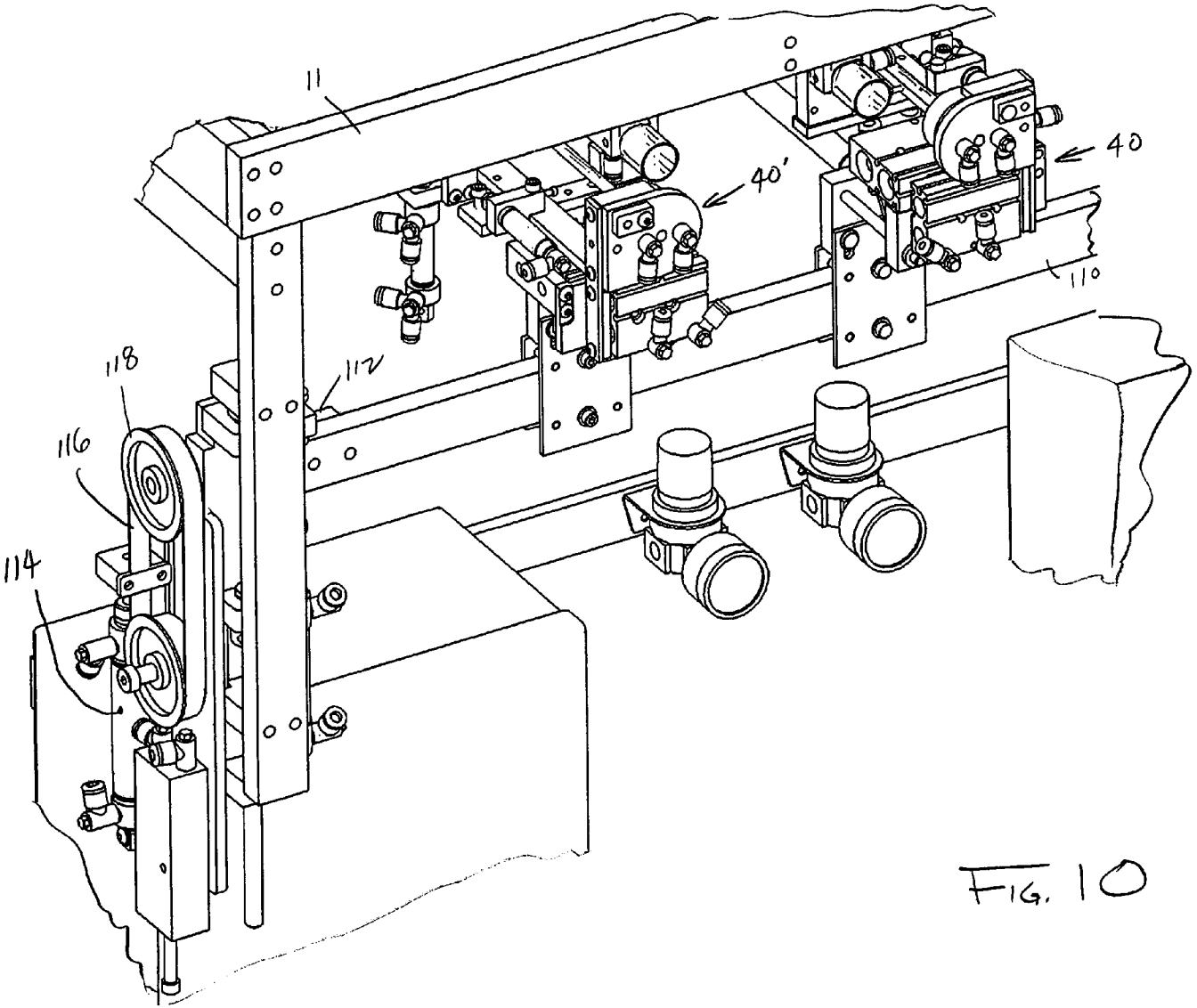
FIG. 10 is a perspective view of another preferred embodiment of the invention showing two bobbin loading assemblies located adjacent to one another in a bobbin loading position for a sewing machine having two parallel needle drives.
Figure 11:
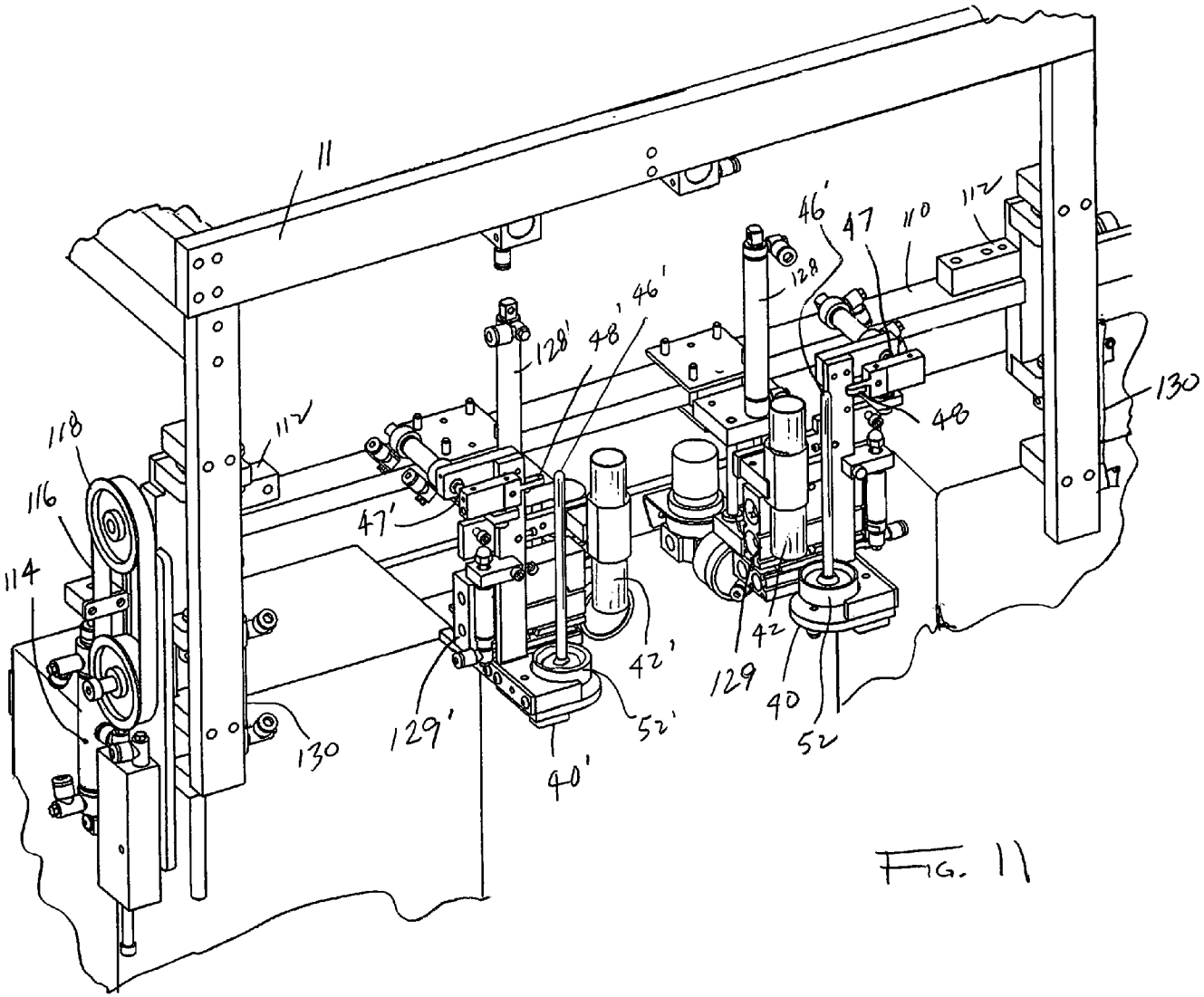
FIG. 11 is a perspective view similar to FIG. 10, showing the two bobbin loading assemblies moved to a bobbin restocking position.

Referring to FIGS. 10 and 11, another aspect of the invention is shown in which two bobbin loading assemblies 40, 40' for a two needle/two hook sewing machine are shown. The bobbin loading assembly 40 is the same as described above, and the second bobbin loading assembly 40' is a mirror image thereof, in order to allow closer positioning of the bobbin loading assemblies 40, 40' to each other. While two bobbin loading assemblies 40, 40' are shown, more or fewer bobbin loading assemblies 40, 40' could be utilized, depending on the number of needle/hook arrangements provided.

The bobbin loading assemblies 40, 40' are mounted on a pivotable frame member 110. The frame member 110 has bearing blocks 112 at each end, as clearly shown in FIG. 11, and is rotated via an actuator 114 by approximately 90° so that the bobbin loading rods 46, 46' are moved to a generally vertical position where they can be restocked with new bobbins. This can be done while the sewing machine continues to operate in order to minimize down time.

In the preferred embodiment, the actuator 114 is a linear actuator, and is connected to a belt 116. The belt 116 rotates a pulley 118 connected to a shaft from the bearing block 112 that is connected to the moveable frame member 110. While this arrangement is preferred, other actuator arrangements, including a rotary actuator could be utilized if desired, and the amount of rotation can be varied from about 75° to about 135°, depending on the particular arrangement. Preferably, the actuators on the bobbin loading assemblies are all pneumatic, and the pneumatic lines (not shown) have enough extra play to allow for the necessary rotation for reloading.

Still with reference to FIG. 11, the Z-direction actuators 128, 128' for the bobbin loading assemblies 40, 40' is shown. Additionally, the X-direction actuators 129, 129' are also shown. The full actuator 47, 47' under the arm 48, 48' is also shown in detail, and is actuated in order to insure that only one new bobbin 16 is loaded, as previously described. The bobbin loading rods 46, 46' with the cup-shaped drivers 52, 52' are also clearly shown.

In a preferred embodiment, the entire pivoting frame member 110, with the bobbin loading assemblies 40, 40' is mounted for up and down movement in the Y direction. The bearing blocks 112 are connected to actuators 130 which move the frame member 110 up and down in order to adjust the height of the bobbin loading assemblies. Preferably, the actuators 130 are lowered prior to pivoting the frame member 110 to rotate the bobbin loading assemblies 40, 40' to the restocking position as shown in FIG. 11.

Figure 12:
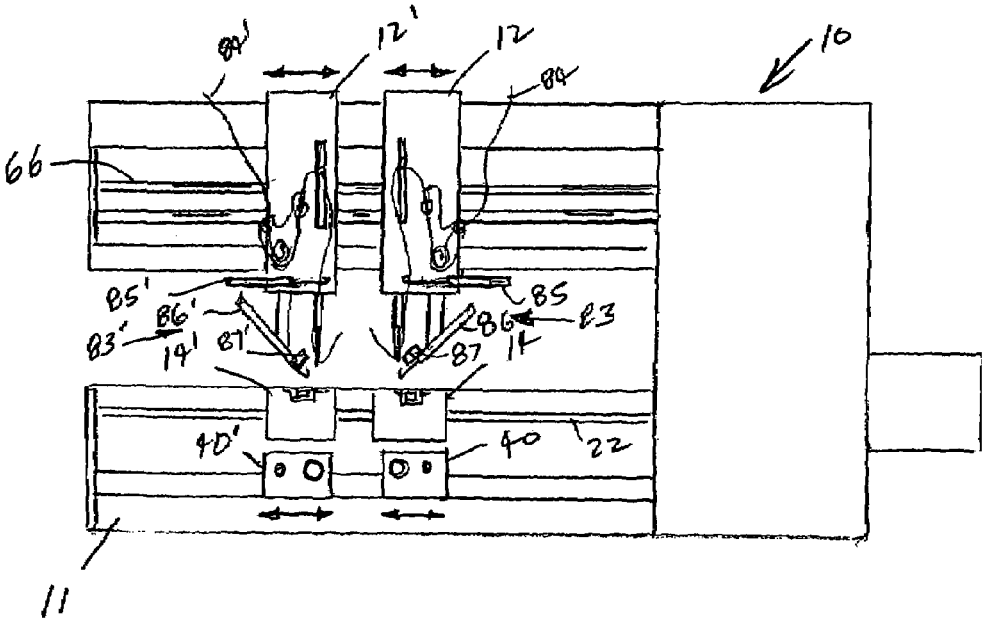
FIG. 12 is a schematic front elevational view of a sewing machine in accordance with the embodiment of the present invention shown in FIGS. 10 and 11, with two movable upper heads, two hooks assemblies and two bobbin loading assemblies on a sewing machine frame.
Figure 13:
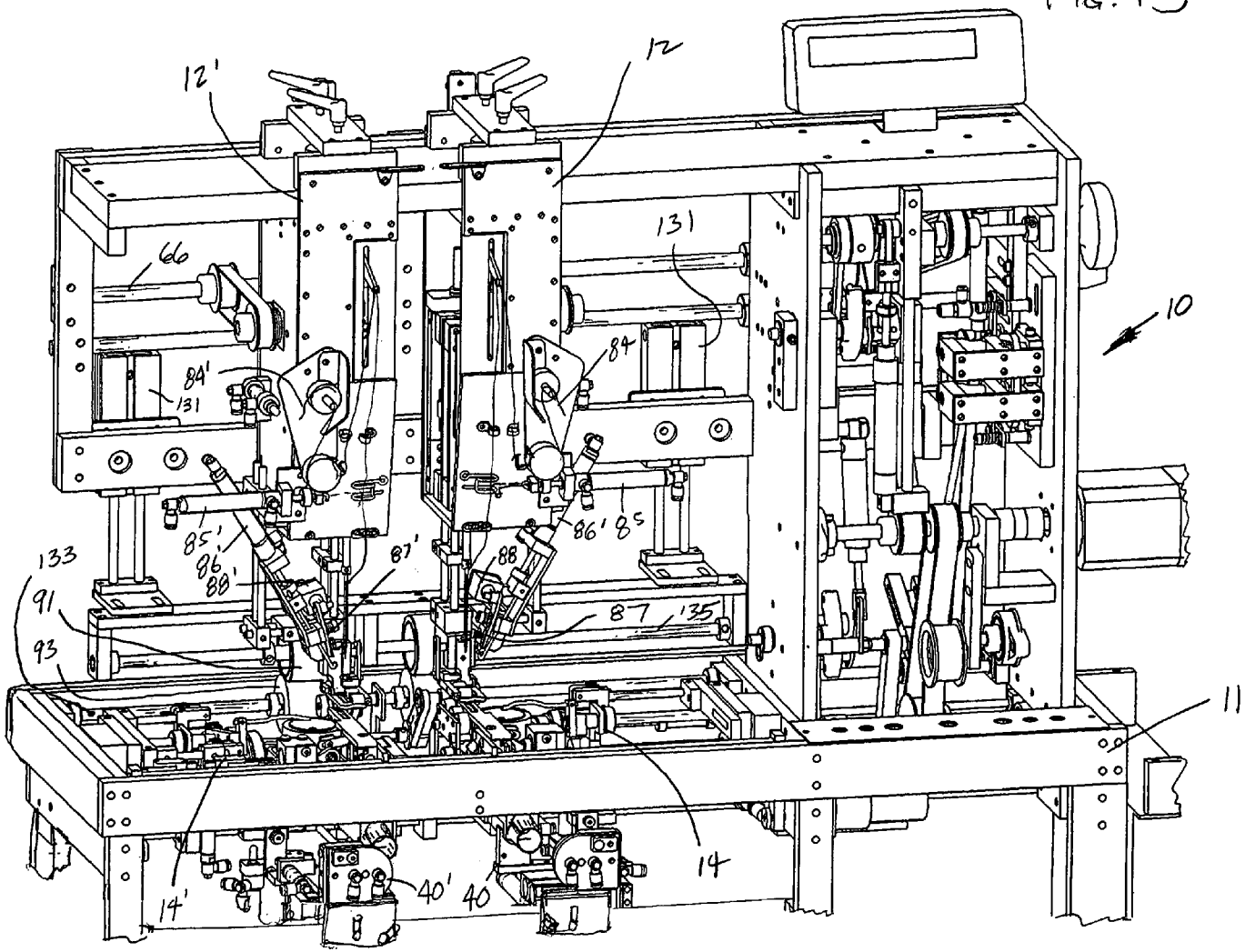
FIG. 13 is a detailed front elevational view of the sewing machine with two moveable upper heads, two hook assemblies and two bobbin loading assemblies of FIG. 12.
Figure 14:
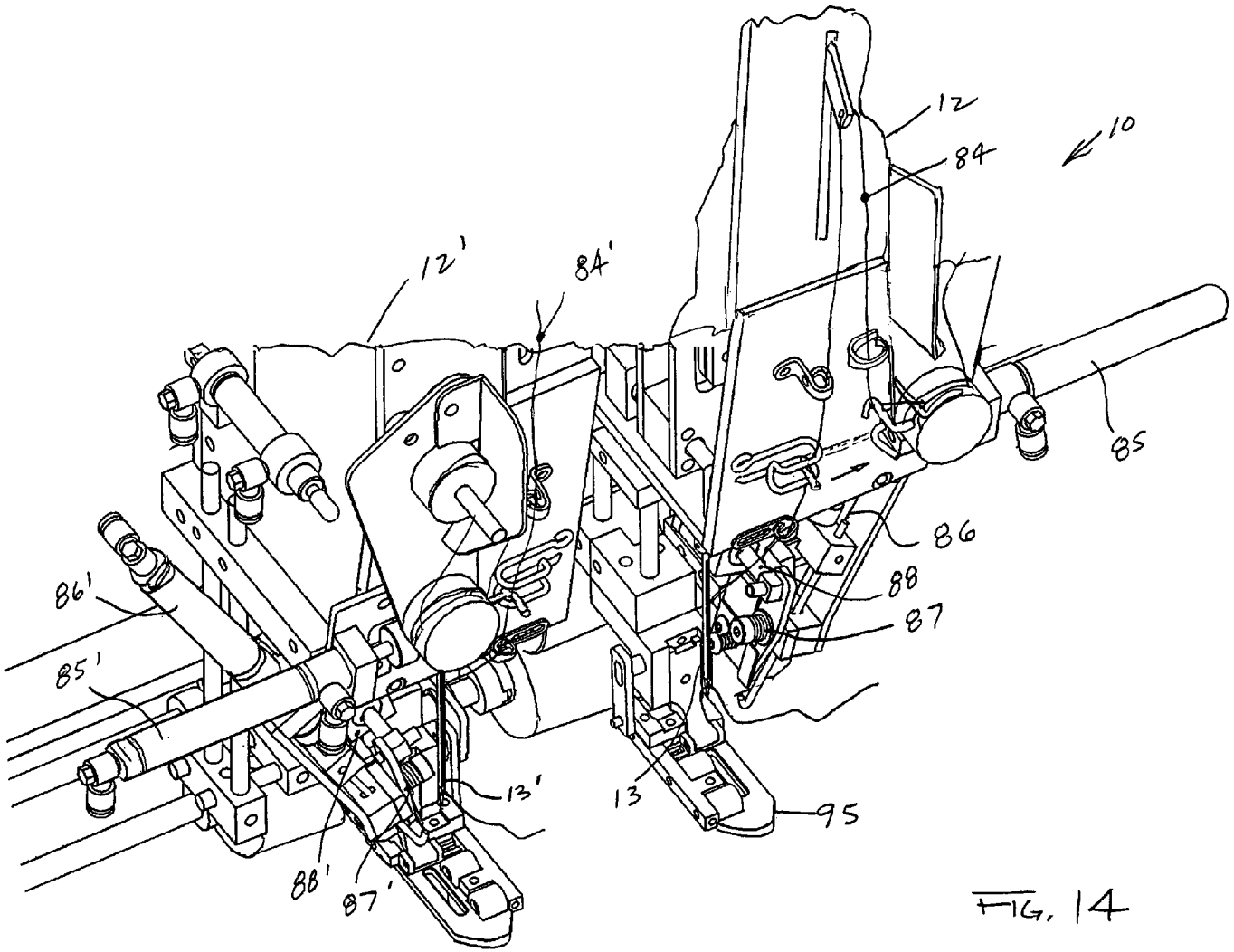
FIG. 14 is an enlarged front perspective view of the needle head assemblies shown in FIG. 13, showing the upper thread pulling and cutting mechanisms.

Referring now to FIGS. 12–14, in a preferred embodiment, the sewing machine 10 includes two upper needle carrying heads 12, 12'. While two heads 12, 12' are illustrated, those skilled in the art will recognize that one, three, four or more heads could be utilized and that the heads 12, 12' along with the hook assemblies 14, 14' are slidable along the frame 11 of the sewing machine 10 to provide a desired spacing between adjacent mirror-image heads 12, 12' of down to approximately 3 inches or less, without any additional measures being taken. The bobbin loading assemblies 40, 40' can be similarly positioned.

Preferably, the drive shafts 66, 22 for each of the heads, 12, 12' and the hook assemblies 14, 14' include a flat that extends along the length of the shafts 66, 22, and the drive pulleys, gears and/or sprockets are slidable to a desired position along each of the drive shafts 66, 22.

Figure 15:
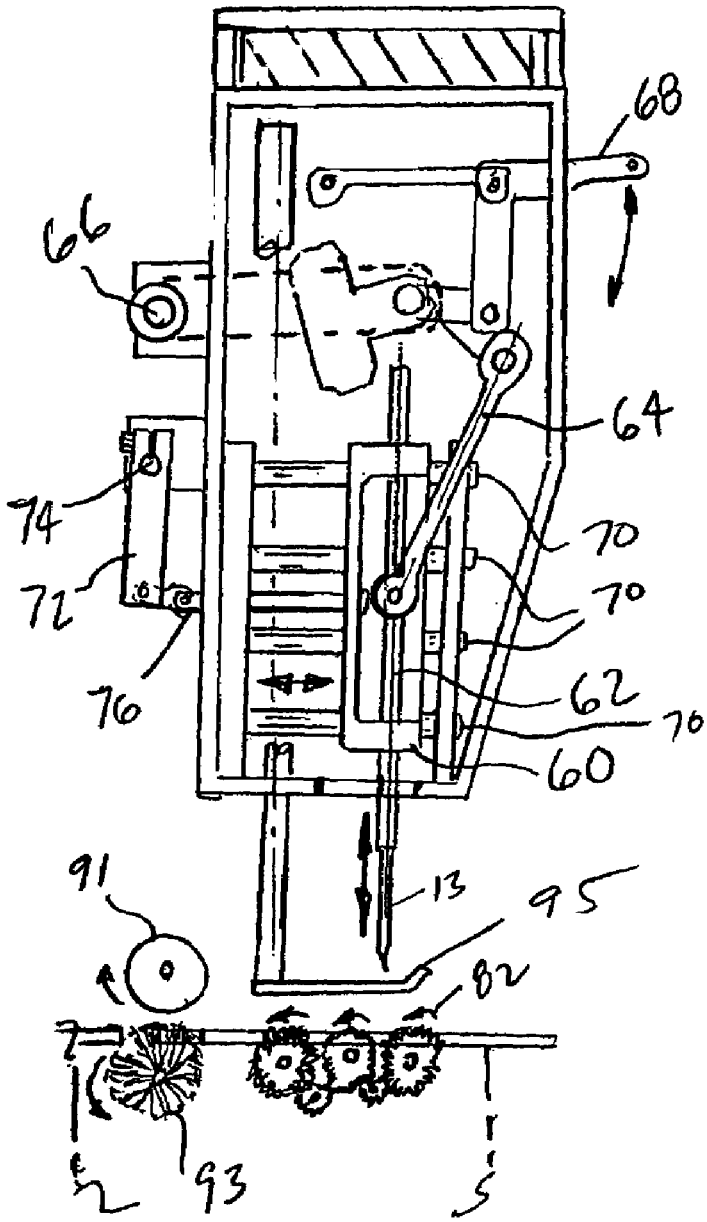
FIG. 15 is a diagrammatic side elevational view of an upper sewing machine head showing the needle carriage assembly and drive arrangement in accordance with a preferred embodiment of the invention.

Referring now to FIG. 15, the needle 13 is mounted on a needle carrying shaft 62 which slides up and down in a needle carriage 60. A drive arm 64 is connected to the needle shaft 62 and is driven by a timing belt drive from drive shaft 66. A counterbalance and lever system is provided for the other movements of the thread advancer 68, in a manner which will be recognized by those skilled in the art.

The needle carriage 60 is also mounted for sliding horizontal movement in the direction of travel of the material being sewn on at least two parallel shafts 70. In one preferred embodiment, shown in FIG. 15, four parallel shafts 70 are provided which extend through bushings in the needle carriage 60. A separate drive arm 72 connected to a drive shaft 74 is connected to the needle carriage 60 via a linkage arrangement 76 to move the needle carriage 60 at the same speed as the material being sewn in the direction of material feed, indicated by the arrows 82, while the needle 14 is in the down position in which it penetrates the material to be sewn. The needle carriage 60 is moved back to the starting position when the needle 13 is in the up position, out of engagement with the material being sewn. This arrangement ensures that the needle 13 maintains a straight up and down path of travel into and out of the material without any tilting movement. This arrangement allows thick materials, for example twelve or more layers of nylon strapping with the thickness of over 1½ inches to be easily sewn together, or the pages of a phone book over two inches thick to be sewn through without breaking the needle 13 or damaging the machine 10.

In accordance with the invention, a commercially available four inch needle has been used to sew through various materials. However, longer needles could be used, if desired, and an adjustable intermediate support can be located next to the needle, if desired, depending on the thickness of the material being sewn together.

In a particularly preferred embodiment, the sewing machine 10 is used to stitch together two different types of material, where one of the materials is a non-woven, randomly aligned fiber mesh at least 0.5 inches thick, which has some free area, preferably at least 40%. This can be attached to a non-permeable layer of polymeric material by sewing in order to form a composite material that is porous in the area of the mesh.

Figure 16:
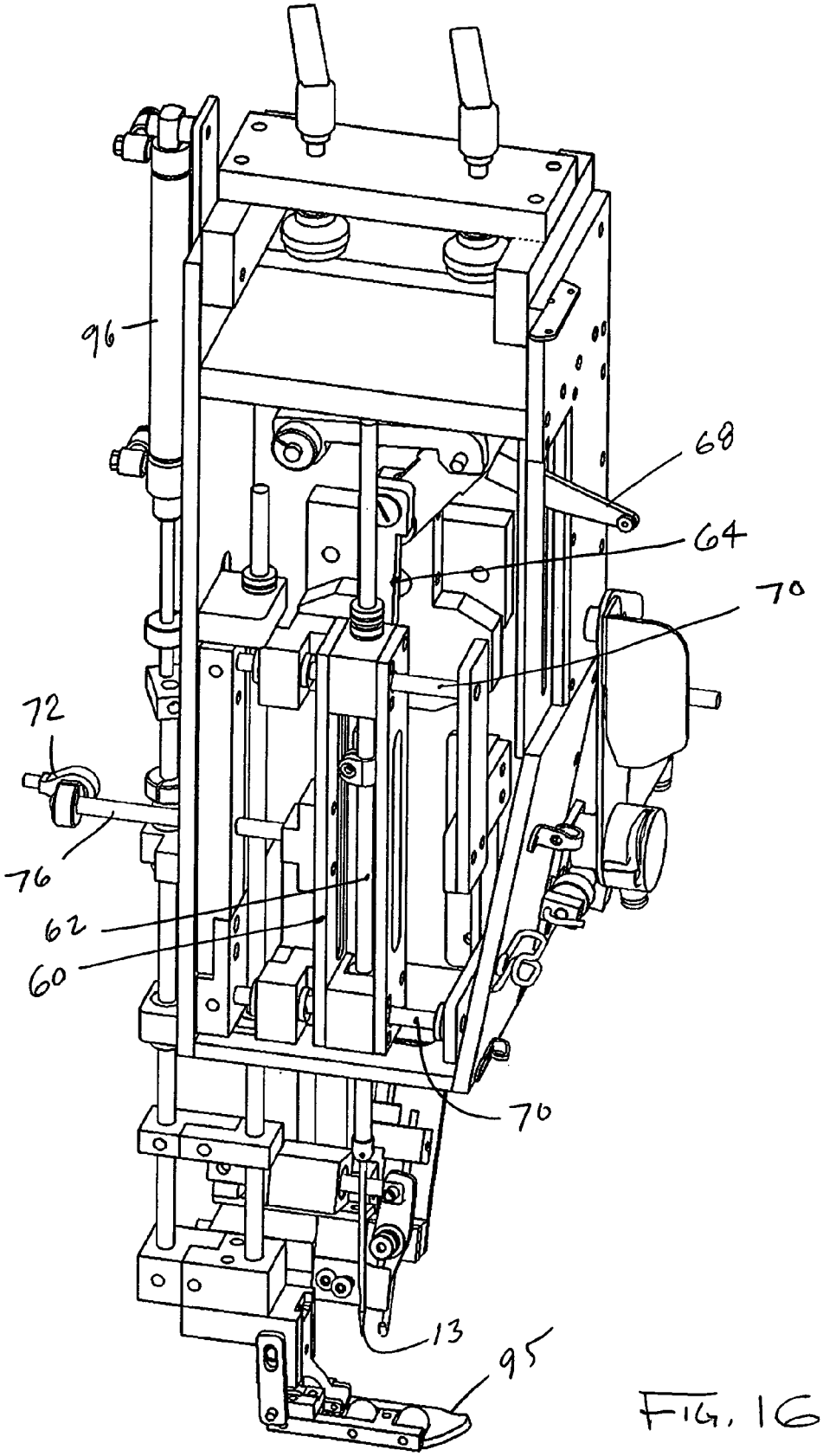
FIG. 16 is a side elevational view of an upper sewing machine head in accordance with another preferred embodiment of the invention showing the needle carriage assembly and drive arrangement, with the needle shown in an uppermost position. (Note: the needle carriage would be driven to the right in this position prior to the needle engaging the material being sewn.)
Figure 17:
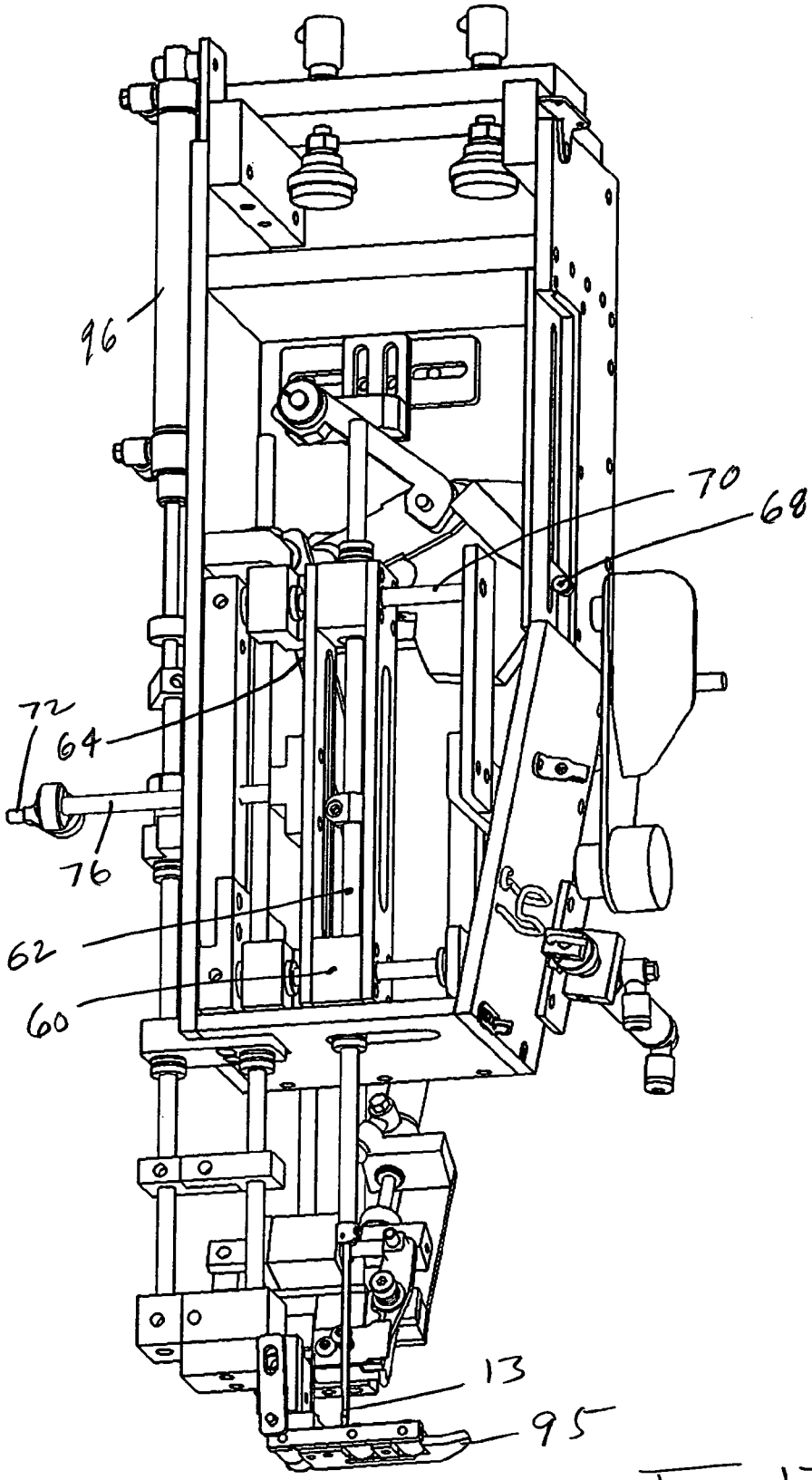
FIG. 17 is a view similar to FIG. 16 showing the upper sewing machine head with the needle in an intermediate position in which the material being sewn would be nearly fully engaged.
Figure 18:
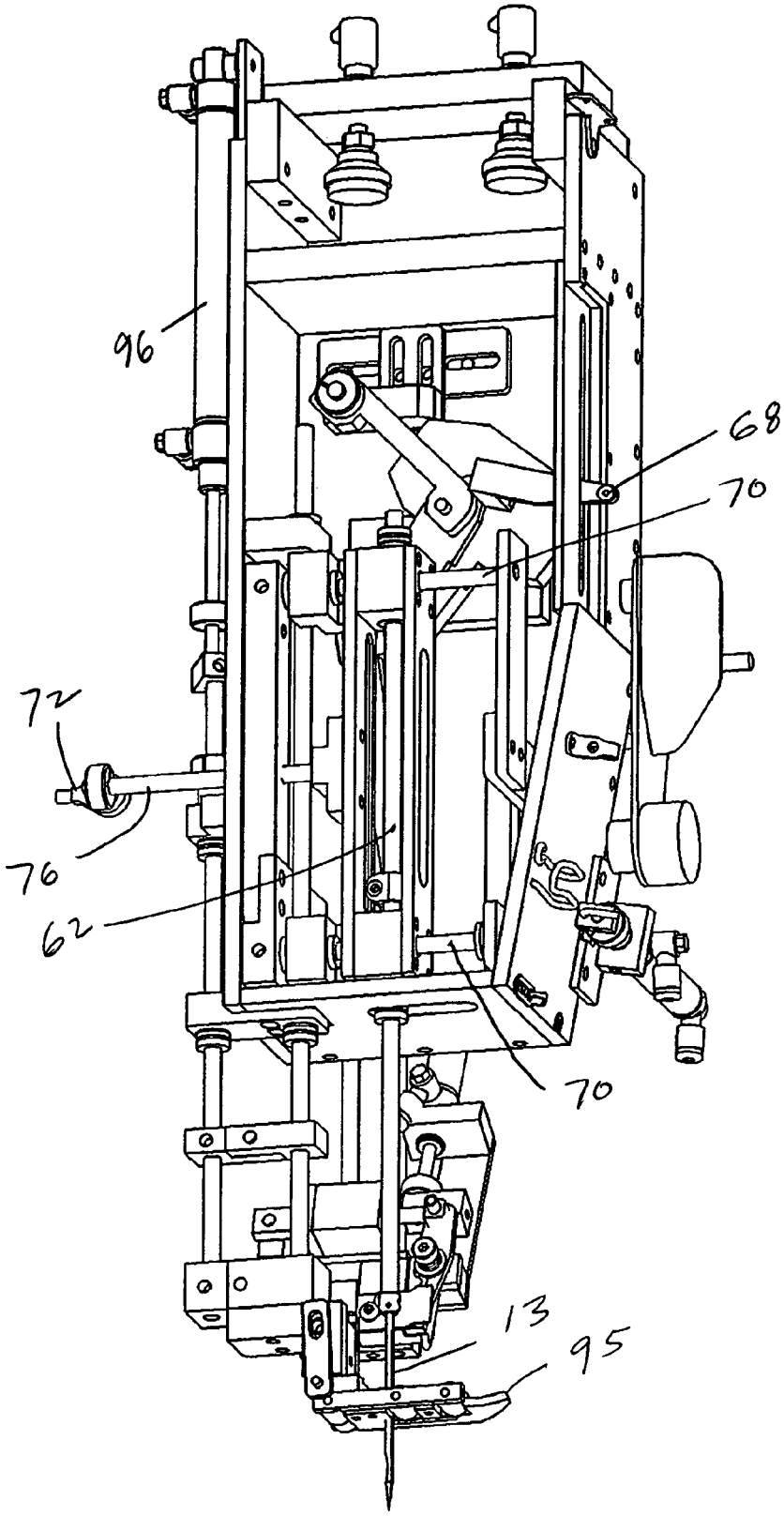
FIG. 18 is a view similar to FIGS. 16 and 17 showing the upper sewing machine head with the needle driven to the lowest position where the hook engages the thread.

Referring to FIGS. 16–18, another preferred embodiment of a head 12 in accordance with the invention is shown in detail. In FIG. 16, the needle 13 is shown in the "up" position; in FIG. 17, the needle 13 is shown in an intermediate position; and in FIG. 18, the needle 13 is shown in the full "down" position. It is noted in these Figures that the linkage 76 to move the needle carriage 60 is not shown being moved for the sake of clarity. However, it is understood based on the present disclosure that during an actual sewing operation, the needle carriage 60 would be in a right-most position along the shafts 70 in FIG. 16, moved slightly leftward on of the shafts 70 in FIG. 17, and in a medial portion of the shafts in FIG. 18. The carriage 60 would continue moving to the left as the needle 13 is drawn back up out of the material.

One difference from the embodiment of the head 12 in FIG. 15 and the embodiment of the head 12 shown in FIGS. 16–18 is that only two shafts 70 are utilized in FIGS. 16–18. The shafts 70 function in the identical manner to allow sliding of the needle carriage 60. The actuator 96 for raising and lowering the foot 95 is also shown.

Referring again to FIGS. 12–14, an automatic thread cutoff system 83, 83' for the upper threads 84, 84' is shown in detail. The automatic thread cut-off system 83, 83' is provided on each of the upper needle carrying heads, 12, 12'. The automatic thread cutoff system comprises a first actuator 85, 85' which hooks and draws excess thread from the thread supply (not shown) prior to cutting. Then cutoff actuators 86, 86' are actuated to draw the thread into a cutter assembly 87, 87' where it is cut via an actuator 88, 88' (best shown in FIG. 14) that closes a scissor-type cutting blade against a fixed blade. This automatic cutoff is beneficial for removing materials and for cutting the thread when the automatic bobbin loader 40 is used to change a spent bobbin.

The material drive wheels 91, 93 (upper and lower shown in FIG. 15) for drawing the material through the sewing machine 10 are also clearly shown in FIG. 13 along with the actuators 131 for moving the upper drive wheels 91 up and down. These material drive wheels 91, 93 are also slidable back and forth on the drive shafts 133 and 135 so that they can be located in the proper position depending upon the position of the needle carrying heads 12, 12' and the hook assemblies 14, 14'.

Figure 19:
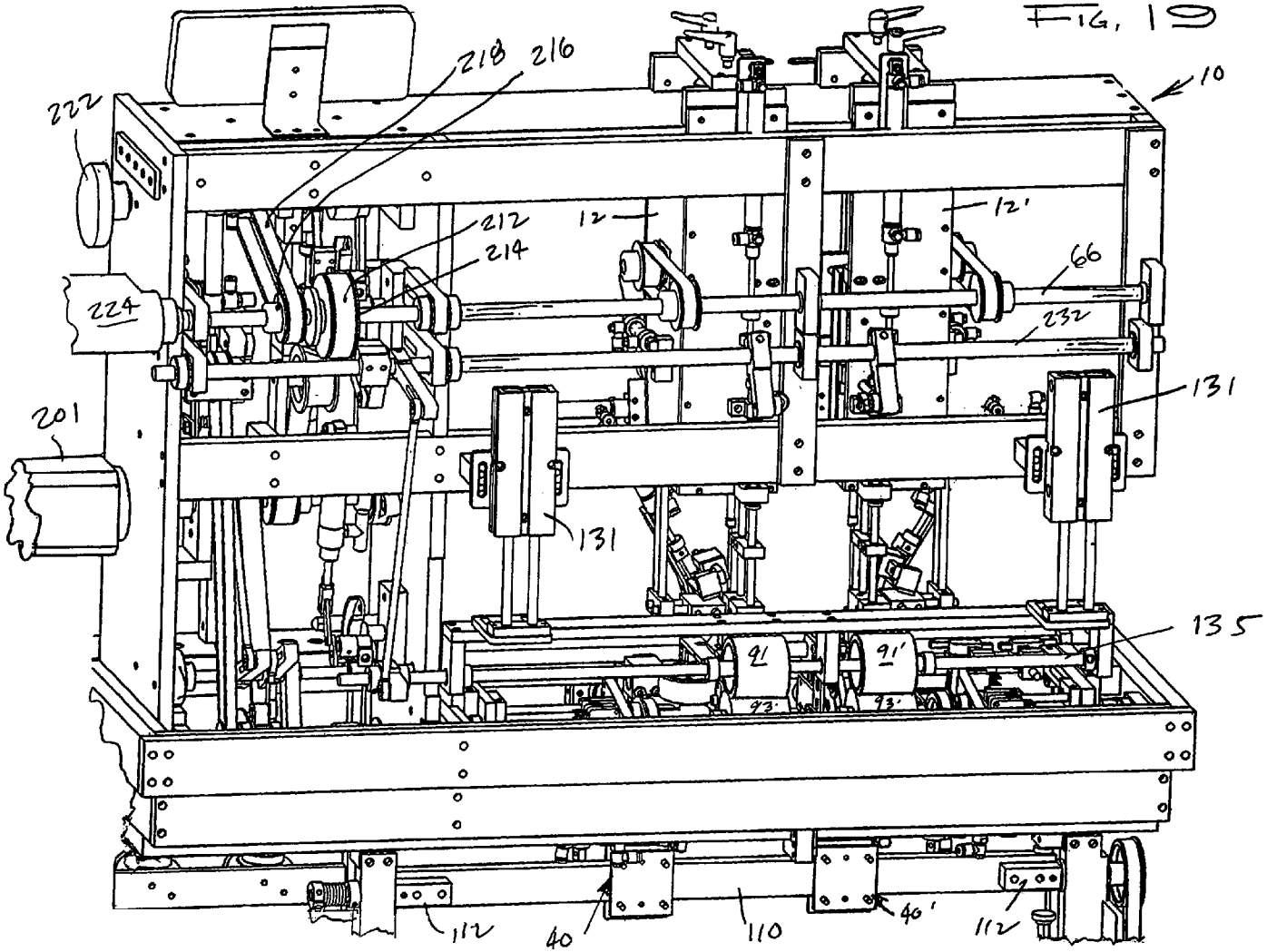
FIG. 19 is a detailed rear elevational view of the sewing machine shown in FIG. 13, showing the drives for the upper sewing machine heads.
Figure 20:
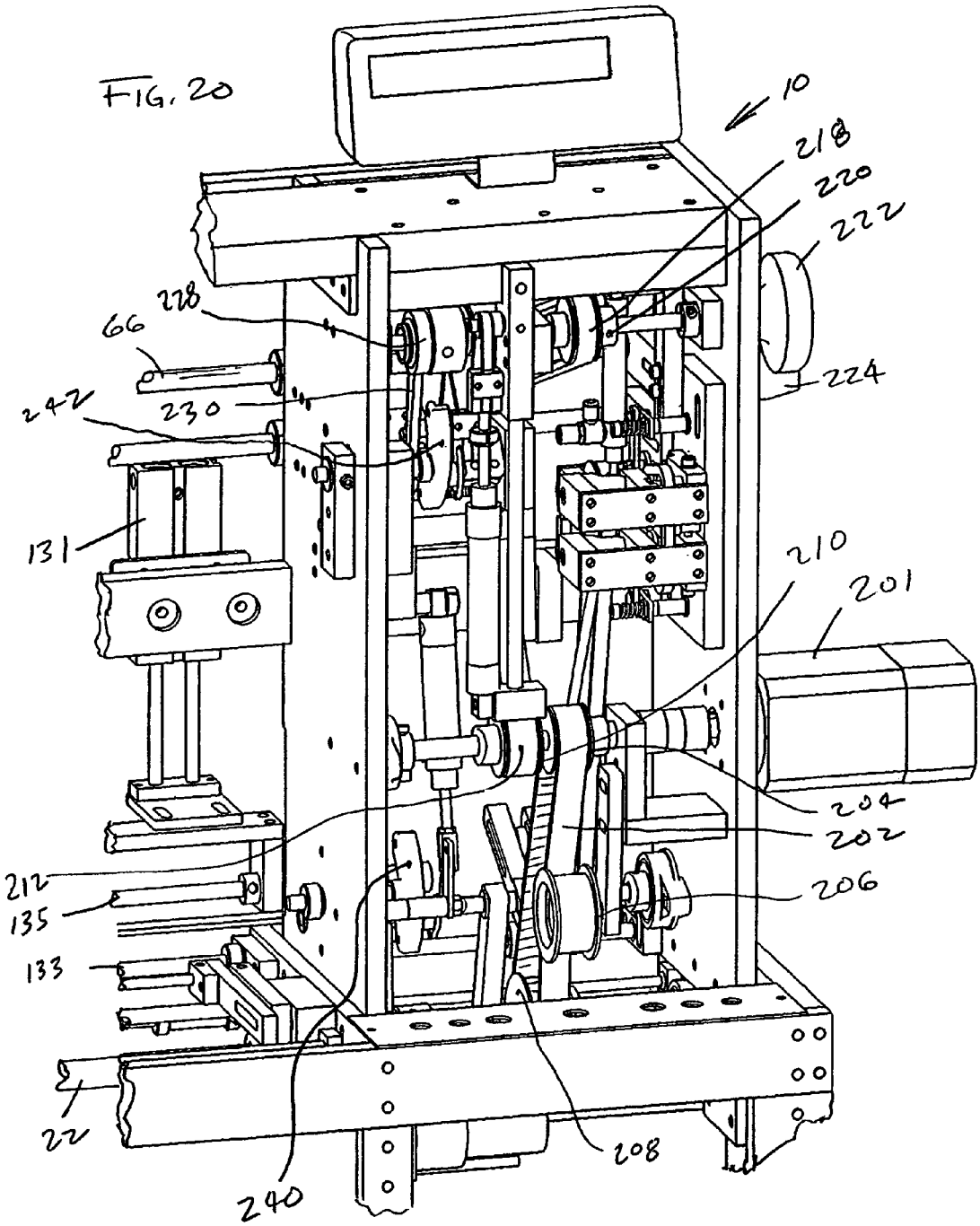
FIG. 20 is an enlarged detailed front perspective view of the drive system for the sewing machine in accordance with the preferred embodiment of the invention shown in FIG. 13.
Figure 21:
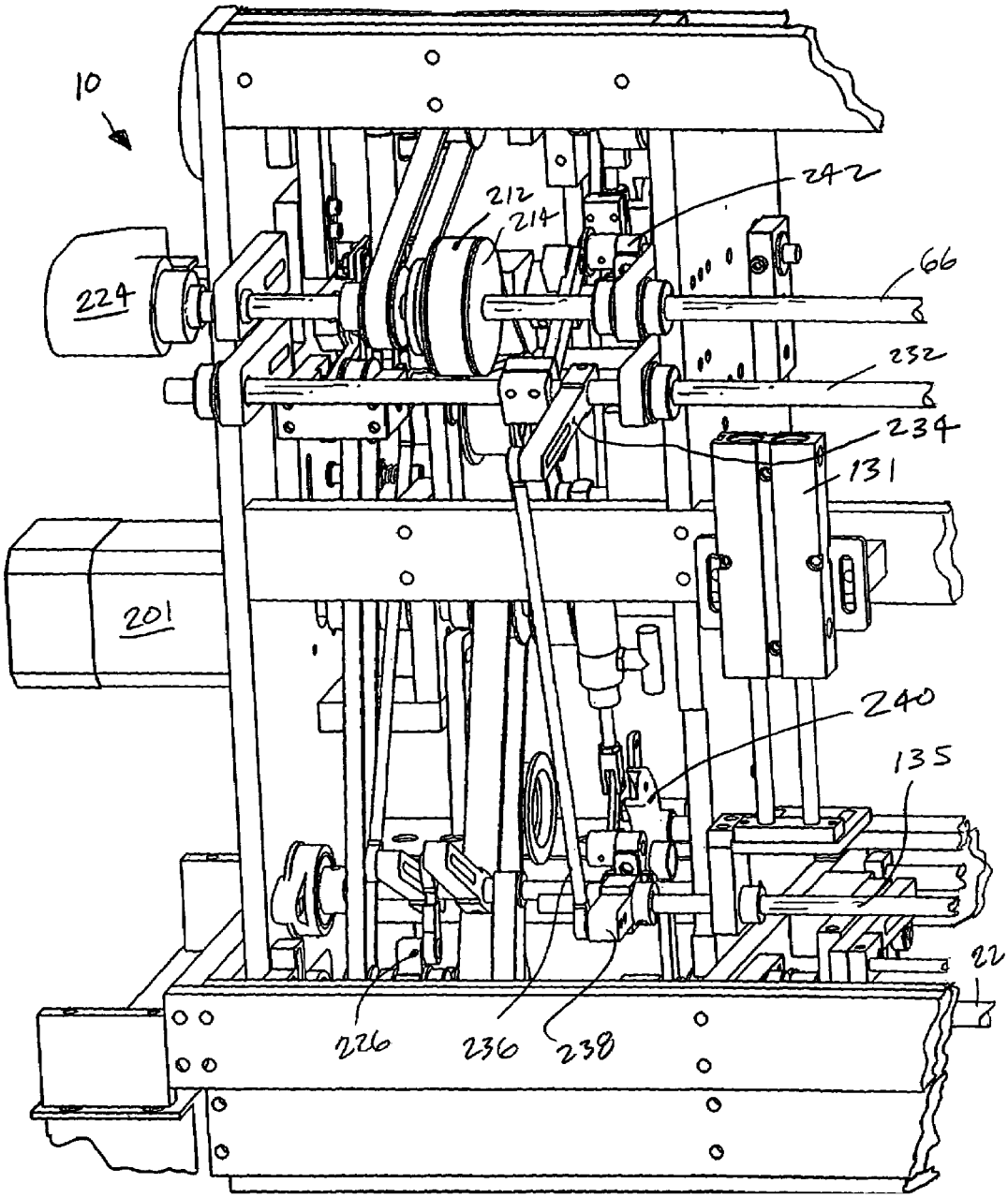
FIG. 21 is an enlarged detailed rear perspective view of the drive system for the sewing machine in accordance with the preferred embodiment of the invention shown in FIG. 13.

The drive arrangement for a preferred embodiment of the sewing machine 10 with two heads 12, 12', hook assemblies 14, 14' and bobbin loading assemblies 40, 40' is shown in FIGS. 19–21. All of the drive shafts are driven via an electric motor 201, shown at the left side of FIG. 19 through a series of drive sprockets and toothed pulleys, cams and followers and reciprocating arrangements in order to provide the correctly timed rotary and oscillating motion to the driven components of the sewing machine 10. The motor 201 drives a toothed drive belt 202 via a pulley 204, shown in FIG. 20. An idler 206 is mounted to tension the drive belt 202. The belt is connected to a pulley 208 mounted on the hook drive shaft 22. A second pulley 210 is mounted on the shaft of the motor 201, and drives a second toothed drive belt 212. As shown in FIGS. 19 and 21, the second toothed drive belt 212 is connected to a drive pulley 214 on the drive shaft 66 for the needle drive. A pulley 216 on the shaft 66 is connected via a belt 218 to a pulley 220 mounted on the shaft of a manual drive handle 222. A speed sensor 224 is preferably located on the end of the shaft 66. An eccentric drive arrangement 226 is connected to the hook drive shaft 22, and drives the lower feed roll drive shaft 133 utilizing a connecting rod and one-way clutch arrangement. A similar eccentric drive 228 connected to the shaft of the manual drive handle 222 is connected via a connecting rod 230 and a one way clutch to the needle carriage drive shaft 232. A further arm 234 and linkage 236 are connected to the shaft 232, and drive the upper feed roll drive shaft 135 through a one-way clutch 238. Reversing arrangements 240 and 242 are preferably provided in the drive lines for the drive rollers and the shaft 232. Preferably, a separate motor or actuator is provided to rotate the shaft 38, shown in FIGS. 8 and 9, to drive the belt 37 used to rotate the hook assemblies 14, 14' from the first, operating position, to the second, bobbin loading position.

While a preferred drive arrangement is shown in FIGS. 19–21, the specific aspects of the drive are not critical and can be varied so long as the correctly timed motions are provided, as will be generally recognized by those skilled in the art.

In the preferred embodiment, the actuators on the sewing machine 10 are pneumatic. However, those skilled in the art will recognize that other types of actuators, such as electric or hydraulic, could be utilized, depending on the particular application.

Utilizing the sewing machine 10 in accordance with the present invention allows for continuous heavy duty sewing of strapping materials and/or other thick materials up to over four inches thick in an efficient manner without the need for manually changing the bobbins 16, as spent bobbins are automatically sensed and replaced. When multiple heads 12 are run at the same time, they can be spaced closer to or apart from each other depending upon the particular application. It is also possible to bridge two adjacent upper heads 12, 12' with a carriage arrangement that carries two very closely spaced needles. The hook assemblies 14, 14' can be moved closer together (within 1 inch) in order to provide very closely spaced, parallel, heavy duty stitching, which can be useful for tarps or other heavy duty strapping applications.

Since the bobbin 16 is automatically changed, this type of sewing machine can be run continuously. Accordingly, it has been found that it is preferable to automatically apply oil to the hook 18 of the hook assembly 14 while the bobbin 16 is loading to prevent excessive wear. Standard hook assemblies do not carry a large enough oil reservoir for the continuous duty provided by the sewing machine 10 of the present invention. The hook assembly 14 is preferably of the standard type of hook assembly and is modified only to be movably mounted in comparison to the standard installation. This is done to allow the hook assembly 14 to rotate about the drive shaft 22. Otherwise, the hook 18 operates in the known manner to loop the upper thread, captured from the needle 13 which penetrates the material to be sewn, around the bobbin 16 as the material to be sewn is drawn forward through the sewing machine 10.

While the automatic bobbin loader is preferred in accordance with the sewing machine of the present invention, it can also be adapted for use in other sewing machines in order to alleviate the need to constantly reload bobbins. This is mainly allowed by movement of the hook assembly 14, preferably by pivoting about the drive shaft 22, in order to provide access for installation of a new bobbin 16 while maintaining the timing of the hook and needle drives. Additionally, while it is preferred that the automatic bobbin loader assemblies are mounted for movement to a restocking position to allow for automated or manual restocking of new bobbins, this is not required in accordance with the invention.

Additionally, providing automatic upper and lower thread cutters while preferably implemented in connection with the automatic bobbin loader can be implemented separately to allow automated cutting of threads of an article that has been sewn.

The needle carriage assembly 60 can also be implemented separately in sewing machines in order to allow the sewing of thicker materials by allowing the needle 13 to move only vertically relative to the material being sewn, without any tilting movement which results in needles snapping. This is done by moving the needle carriage 60 horizontally in time with the material being sewn during the period in which the needle 13 is inserted.

The sewing machine 10 in accordance with the invention therefore provides several advantages in sewing thick and/or stiff article in a continuous operating manner and without needle breakage.

Preferably, control of the sewing machine 10 is implemented via a PLC so that the movement of the actuators can be controlled based upon sensors provided.

While the various drives have been described in the preferred embodiments as utilizing toothed belts and toothed pulleys, those skilled in the art will recognize that other types of drives could be utilized, such as direct gear drives, chain and sprocket drives, or any other known drive that allows the timing between the various components to be maintained.

While the preferred embodiments of the invention have been described in detail, the invention is not limited to the specific embodiments described above, which should be considered as merely exemplary. Further modifications and extensions of the present invention may be developed, and all such modifications are deemed to be within the scope of the present invention as defined by the appended claims.

What is claimed is:

1. A sewing machine, comprising:

a frame having an upper sewing head and a lower hook assembly supported thereon;

the hook assembly mounted beneath a support plane for material to be sewed and including a bobbin receiver, the hook assembly being driven by a drive shaft, and being pivotable about an axis of the drive shaft from a first, operating position, to a second, bobbin loading position;

a bobbin loader mounted for movement in a position adjacent to the hook assembly in the second, loading position, the bobbin loader including a removal device that removes any remaining bobbin core, and a bobbin feeder that loads a replacement bobbin from the bobbin loader into the bobbin receiver in the hook assembly.

2. The sewing machine of claim 1, wherein the hook assembly includes a sensor to detect when the bobbin is nearly spent.

3. The sewing machine of claim 1, further comprising rotary dogs for driving material through the sewing machine formed as a plurality of toothed rollers which are disengagable from a drive wheel when the hook assembly is moved from the first, operating position to the second, bobbin loading position.

4. The sewing machine of claim 1, wherein the bobbin loader includes a supply of bobbins loaded onto a feed rod.

5. The sewing machine of claim 1, wherein to load a single bobbin into the bobbin receiver of the hook assembly, the bobbins on the feed rod are pushed forward by a pusher such that the last bobbin is adapted to slide off the end of the feed rod and into the bobbin receiver.

6. The sewing machine of claim 1, wherein a control arm is located on the bobbin loader to allow only one bobbin to be released from the feed rod into the bobbin receiver.

7. The sewing machine of claim 1, wherein the bobbin loader is mounted for movement in at least two axes to allow for movement toward and away from the hook assembly when it is in the second, loading position.

8. The sewing machine of claim 1, wherein the removal device comprises a suction tube.

9. The sewing machine of claim 8, wherein a venturi is used with the suction tube to remove a spent bobbin from the bobbin receiver.

10. The sewing machine of claim 8, wherein the suction tube is mounted for pivoting movement on the bobbin loader.

11. The sewing machine of claim 1, wherein a bobbin hold-down arm is mounted separately from the hook assembly and is driven up and down in time with a sewing machine drive such that it lifted upwardly from the bobbin to allow a loop of upper thread to pass under the arm.

12. The sewing machine of claim 11, further comprising sensors attached to the arm to detect when the bobbin is nearly spent and signal a controller to trigger a reloading operation to occur.

13. The sewing machine of claim 12, further comprising a bobbin thread cutter that engages the bobbin thread and cuts it upon the hold down arm detecting that the bobbin in the bobbin receiver is nearly spent.

14. The sewing machine of claim 13, further comprising an upper thread cutter that engages an upper thread and cuts it to prevent additional thread pulling during a bobbin changing operation.

15. The sewing machine of claim 1, wherein the hook assembly is slidable along the drive shaft so that it can be positioned in any one of a number of positions.

16. The sewing machine of claim 1, further comprising a second upper head and a second hook assembly, the, upper heads and hook assemblies being slidable along the frame and the drive shafts to allow a throat width of the sewing machine to be adjusted and/or to allow multiple sewing heads to be placed at varying distances from one another.

17. The sewing machine of claim 1, wherein the hook assembly is rotated from the first position to the second position via a rotary drive.

18. The sewing machine of claim 1, wherein the bobbin feeder comprises a bobbin holding rod upon which a plurality of bobbins are slidably located, and a pusher for pushing a last bobbin from the holding rod into the bobbin receiver.

19. The sewing machine of claim 18, wherein the bobbin is inserted into the bobbin receiver of the hook assembly using a blast of air pressure.

20. The sewing machine of claim 1, wherein the bobbin loader is moveable to a restocking position where one or more new bobbins can be loaded while the sewing machine continues to operate.

21. The sewing machine of claim 20, wherein a bobbin holding feed rod is pivotbly mounted on the bobbin loader and is pivotable toward an operator in a reloading position so that a plurality of new bobbins can be loaded at the same time.

22. The sewing machine of claim 1, comprising a plurality of sewing heads and hook assemblies mounted to the frame which are adjustable to a desired spacing to allow for multiple stitching to occur at the same time.

23. The sewing machine of claim 1, wherein an upper thread carrying needle of the upper head is mounted on a needle carriage to allow the sewing machine to sew through multiple layers of thick material.

24. The sewing machine of claim 23, wherein the needle carriage is mounted for sliding horizontal movement in time with a movement of material being sewn through the sewing machine.

25. The sewing machine of claim 23, wherein the needle is mounted for transverse movement in the needle carriage such that the needle moves upwardly and downwardly in order to sew while the needle carriage moves horizontally back and forth in time with the material being sewn.

26. The sewing machine of claim 23, wherein the needle is inserted such that the needle is maintained in a generally parallel, vertical alignment during a sewing operation, eliminating tilting of the needle.

27. The sewing machine of claim 23, wherein the needle carriage is mounted for sliding movement on at least two horizontal guide rods and is driven in time with the movement of the needle into the material to be sewn and moved horizontally in time with feed rollers which draw the material to be sewn through the sewing machine.

28. The sewing machine of claim 1, further comprising a thread pull and thread cutoff device located on the upper head for the upper thread which include a first hook driven by an actuator to create extra slack in the upper thread and a second actuator to draw the thread from the needle to an actuator driven cutting device which cuts the thread while still leaving a sufficient thread tail through the needle to restart the sewing operation without having to rethread the needle.

29. A sewing machine, comprising:

a frame having an upper sewing head and a lower hook assembly supported thereon;

an upper thread carrying needle of the upper head is mounted on a needle carriage; and the needle carriage is mounted for sliding horizontal movement in time with a movement of material being sewn through the sewing machine such that the needle is maintained in a generally parallel, vertical alignment during a sewing operation, eliminating tilting of the needle to allow the sewing machine to sew through multiple layers of thick material.

30. The sewing machine of claim 29, wherein the needle carriage is sliadbly mounted on two generally horizontal guide shafts.

31. The sewing machine of claim 30, wherein a drive linkage is connected to the needle carriage.

* * * * *